US010492599B2

(12) United States Patent
Hoyle

(10) Patent No.: US 10,492,599 B2
(45) Date of Patent: Dec. 3, 2019

(54) FOLDING LEG ASSEMBLY FOR SELF-LEVELING TABLE

(71) Applicant: Gary C. Hoyle, Cumming, GA (US)

(72) Inventor: Gary C. Hoyle, Cumming, GA (US)

(73) Assignee: G.C. Hoyle Company LLC, Cumming, GA (US)

( * ) Notice: Subject to any disclaimer, the term of this patent is extended or adjusted under 35 U.S.C. 154(b) by 0 days.

(21) Appl. No.: 15/928,801

(22) Filed: Mar. 22, 2018

(65) Prior Publication Data

US 2019/0289997 A1 Sep. 26, 2019

(51) Int. Cl.

| | |
|---|---|
| ***A47B 3/00*** | (2006.01) |
| ***A47B 13/00*** | (2006.01) |
| ***A47B 13/08*** | (2006.01) |
| ***A47B 3/091*** | (2006.01) |
| *A47B 3/08* | (2006.01) |

(52) U.S. Cl.

CPC ..... *A47B 13/003* (2013.01); *A47B 3/0916* (2013.01); *A47B 13/081* (2013.01); *A47B 3/002* (2013.01); *A47B 3/08* (2013.01); *A47B 3/0803* (2013.01)

(58) Field of Classification Search

USPC ..... 248/188, 188.1, 188.6, 186.1, 183.1, 248/183.2; 108/125, 126, 129, 130

See application file for complete search history.

(56) References Cited

U.S. PATENT DOCUMENTS

| | | | | |
|---|---|---|---|---|
| 4,457,399 A * | 7/1984 | Breisch | B25H 1/06 182/151 |
| 5,377,779 A * | 1/1995 | Slapnicka | B25H 1/06 182/153 |
| 9,140,401 B2 * | 9/2015 | Hoyle | F16M 11/00 |
| 9,453,608 B2 | 9/2016 | Hoyle | |

* cited by examiner

*Primary Examiner* — Alfred J Wujciak

(74) *Attorney, Agent, or Firm* — Frost Brown Todd LLC

(57) ABSTRACT

A foldable leg assembly for use with self-leveling platforms, tables, and devices that includes at least one rotatable bracket assembly having a first section with an upper portion and a lower portion, wherein a curved channel is formed in the upper portion and wherein a stem and flange receiving region is formed in the lower portion; and a second section adapted to be connected to the first section and having an upper portion and a lower portion, wherein a curved channel is formed in the upper portion and wherein a stem and flange receiving region is formed in the lower portion; and at least one support device having a pivot device that is adapted to pivotally and rotationally engage the stem and flange receiving regions of the at least one rotatable bracket assembly, wherein the pivot device further includes a stem; a flange positioned on top of the stem; and a leg receiving portion.

13 Claims, 5 Drawing Sheets

FOLDING LEG ASSEMBLY FOR SELF-LEVELING TABLE

BACKGROUND OF THE INVENTION

The described invention relates in general to self-leveling tables, platforms, benches, chairs, stands, supports, and other substantially flat or planar surfaces of various shapes, and more specifically to foldable leg assemblies for use with such devices.

Substantially flat or planar platforms are common utilitarian components found in many items including tables; benches; chairs; cooking surfaces; work surfaces; elevated storage containers; hunting, fishing, and camping products; and many others. Most of these platforms are most useful when they are in a level position (i.e., positioned horizontally). However, placing and holding a substantially flat or planar platform in a level position can be challenging, particularly when the surface or substrate upon which the platform is placed is uneven. In restaurants, coffee shops, and other establishments, encountering tables or chairs that wobble or tilt, or that are otherwise unstable is a common and annoying occurrence for many people. An unstable table or chair is also more likely to collapse or fall over, thereby creating a risk of injury to the person using the item. Furthermore, an unstable work platform may present a significant safety hazard, particularly if the platform is being used for activity that involves sawing or other reciprocating motion that would encourage the work platform to tip over or collapse. Legs or other support structures attached to such platforms may be collapsible, foldable, or adjustable with regard to height and/or angle relative to the platform itself; however, these support structures are not typically adjustable with regard to maintaining the platform in a level position when the platform is sitting on an uneven substrate.

Self-adjusting support assemblies for use on uneven substrates or surfaces are described in U.S. Pat. Nos. 9,140,401 and 9,453,608, which are incorporated herein by reference, in their entirety, for all purposes. U.S. Pat. Nos. 9,140,401 and 9,453,608 both teach a self-adjusting support assembly for use on uneven surfaces that includes: (a) a support element (e.g., a platform, work surface, tabletop, or seat); (b) at least one pivoting leg assembly positioned beneath the support element; and (c) at least one self-adjusting attachment assembly connecting the support element to the at least one pivoting leg assembly. Each self-adjusting attachment assembly includes: (i) a bracket that is adapted to attach to the support element; and (ii) a proximal head portion that is adapted to rotationally cooperate with the bracket and to receive the pivoting leg assembly. The bracket includes: (i) a receiving channel formed therein that is positioned along a predetermined angled axis of insertion; and (ii) a locking ridge positioned within the receiving channel. The proximal head portion includes: (i) a flange formed at one end thereof that rotationally engages the locking ridge; (ii) a stem positioned beneath the flange that rotationally engages the receiving channel; and (iii) a receiving portion positioned beneath the stem that is adapted to receive the pivoting leg assembly.

The self-adjusting attachment assemblies taught by U.S. Pat. Nos. 9,140,401 and 9,453,608 can be attached to and effectively used with almost any type of platform, and many types of pre-existing devices (tables, benches, chairs, etc.) can be modified by retrofitting to include the self-adjusting attachment assemblies and the pivoting leg assemblies with which the self-adjusting attachment assemblies are designed to work. The self-adjusting attachment assemblies and the pivoting leg assemblies may also be integrated into various types of platforms. However, the pivoting leg assemblies, which are typically triangular, can create certain challenges associated with transporting and storing the platforms to which the pivoting leg assemblies are attached or into which they are integrated. Accordingly, there is a need for leg assemblies for use with the self-leveling devices described in U.S. Pat. Nos. 9,140,401 and 9,453,608 that may be folded to conserve space and facilitate transporting and storing the platforms to which the leg assemblies are attached.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a first foldable leg assembly for use with a self-leveling platform is provided. This foldable leg assembly includes at least one rotatable bracket assembly that further includes a first section including an upper portion and a lower portion, wherein a curved channel is formed in the upper portion thereof and wherein a stem and flange receiving region is formed in the lower portion thereof; and a second section adapted to be connected to the first section, wherein the second section includes an upper portion and a lower portion, wherein a curved channel is formed in the upper portion thereof and wherein a stem and flange receiving region is formed in the lower portion thereof; and at least one support device that further includes a pivot device that is adapted to pivotally and rotationally engage the stem and flange receiving regions of the at least one rotatable bracket assembly, and wherein the pivot device further includes a stem; a flange positioned on top of the stem; and a leg receiving portion, wherein the leg receiving portion is adapted to receive at least two legs therein.

In accordance with another aspect of the present invention, a second foldable leg assembly for use with a self-leveling platform is provided. This foldable leg assembly includes at least one rotatable bracket assembly that further includes a first section including an upper portion and a lower portion, wherein a curved channel is formed in the upper portion thereof and wherein a stem and flange receiving region is formed in the lower portion thereof; and a second section adapted to be connected to the first section, wherein the second section includes an upper portion and a lower portion, wherein a curved channel is formed in the upper portion thereof and wherein a stem and flange receiving region is formed in the lower portion thereof; and at least one support device that further includes a pivot device that is adapted to pivotally and rotationally engage the stem and flange receiving regions of the at least one rotatable bracket assembly, and wherein the pivot device further includes a stem; a flange positioned on top of the stem; a leg receiving portion, wherein the leg receiving portion is adapted to receive at least two legs therein; a first leg and a second leg mounted within the leg receiving portion; and a crossbar positioned between the first and second legs such that the two legs and the crossbar form a triangular configuration.

In yet another aspect of this invention, a third foldable leg assembly for use with a self-leveling platform is provided. This foldable leg assembly includes at least two rotatable bracket assemblies, wherein each rotatable bracket assembly further includes a first section including an upper portion and a lower portion, wherein a curved channel is formed in the upper portion thereof and wherein a stem and flange receiving region is formed in the lower portion thereof; and a second section adapted to be connected to the first section, wherein the second section includes an upper portion and a lower portion, wherein a curved channel is formed in the upper portion thereof and wherein a stem and flange receiving region is formed in the lower portion thereof; and at least two support devices, wherein each support device further includes a pivot device that is adapted to pivotally and rotationally engage the stem and flange receiving regions of each rotatable bracket assembly, and wherein each pivot device further includes a stem; a flange positioned on top of the stem; and a leg receiving portion, wherein the leg receiving portion is adapted to receive at least two legs therein.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
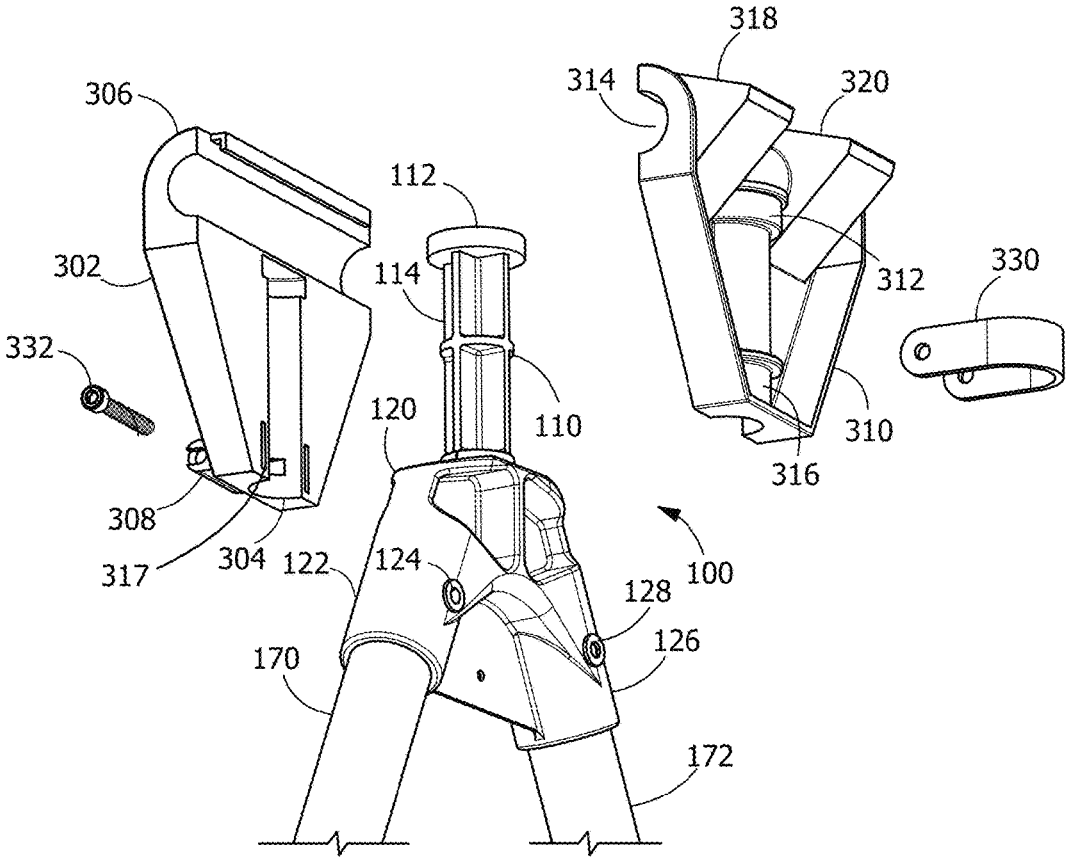
FIG. 1 is an exploded, perspective view of a first support assembly and first rotating bracket assembly in accordance with an exemplary embodiment of the present invention.

Exemplary embodiments of the present invention are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention provides folding or foldable leg assemblies for use with the self-leveling devices described in U.S. Pat. Nos. 9,140,401 and 9,453,608 and other systems and devices. The STABLZ® family of products provides various platforms that are supported by sets of triangular legs that operate to "self-level" these platforms on uneven substrates. Within the context of this invention and in describing the STABLZ® products generally, the phrase "self-leveling" refers to the mechanical relationship between the platform, the legs (which are typically triangular in overall shape) that support the platform, and the bracket assembly that attaches the legs to the platform. The bracket assembly receives and houses the legs in a manner that permits the upper portion of the legs to rotate and pivot, independent of one another, thereby permitting a user of the device to orient the platform in a level position even if the bottom portions of the legs are resting on an uneven substrate or surface. The platforms compatible with this system can vary in size, weight, and shape; however, the triangular pivoting leg assemblies can create certain challenges associated with transporting and storing the platforms to which the leg assemblies are attached. Accordingly, the present invention provides folding leg assemblies for use with the bracket assemblies described above, wherein the folding leg assemblies can be collapsed to occupy less physical space, thereby facilitating transportation and storage of the entire self-leveling device.

With reference to the Figures, FIG. 1 is an exploded, perspective view of first support assembly 100 and first rotating bracket assembly 300 in accordance with an exemplary embodiment of the present invention. First support assembly 100 includes pivot device 110, which is adapted to pivotally and rotationally engage first rotating bracket assembly 300. Pivot device 110 includes flange 112, which is positioned on top of stem 114. Upper leg receptacle 120 is formed integrally with pivot device 110 and includes first leg receiving portion 122, and second leg receiving portion 126. First leg 170 is inserted into first leg receiving portion 122 and secured therein by first bolt or rivet 124. Second leg 172 is inserted into second leg receiving portion 126 and secured therein by second bolt or rivet 128. First rotating bracket assembly 300 includes rear bracket portion 302 and front bracket portion 310. Rear bracket portion 302 includes flange and stem receiving portion 304 (corresponding to the geometry of flange 112 and stem 114 on pivot device 110), dowel receiving portion 306, and bolt receiving portion 308. Front bracket portion 310 includes flange and stem receiving portion 312 (corresponding to the geometry of flange 112 and stem 114 on pivot device 110), dowel receiving portion 314, collar receiving portion 316, first rotational stop 318, and second rotational stop 320.

Figure 2:
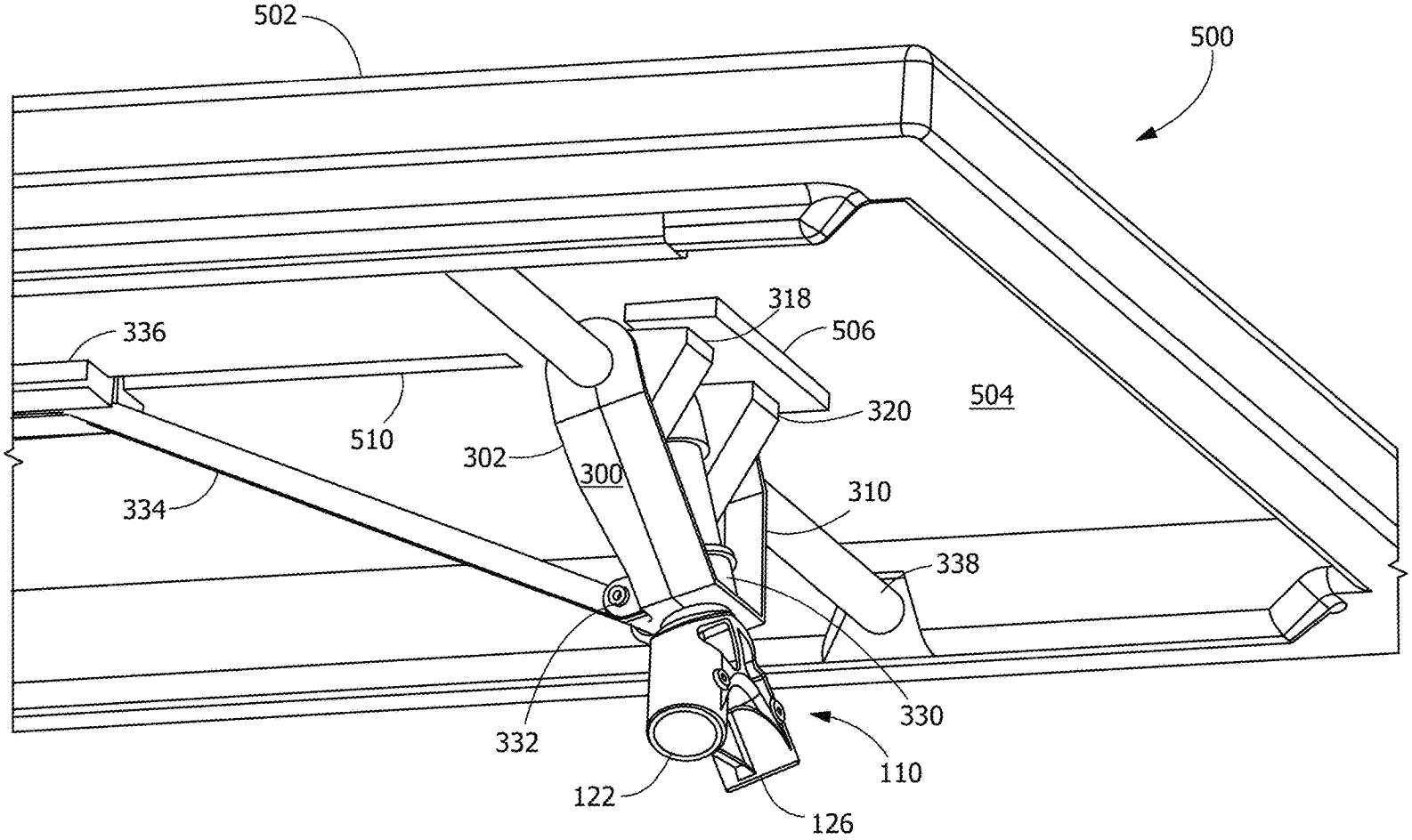
FIG. 2 is an assembled, perspective view of the first support assembly and first rotating bracket assembly of FIG. 1 shown mounted in a rotatable manner on the bottom surface of a table top.
Figure 3:
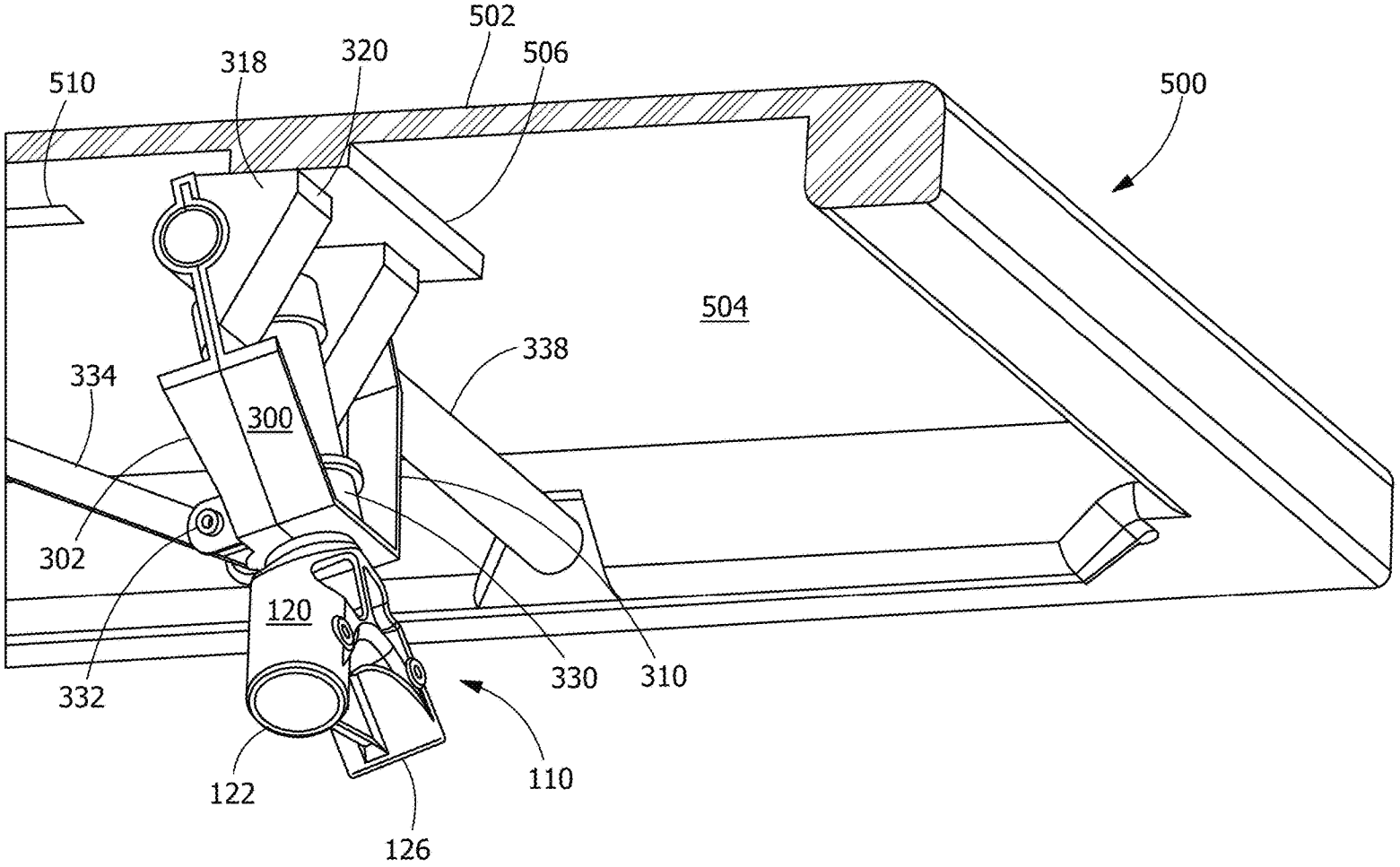
FIG. 3 is an assembled, partial cross-sectional, perspective view of the first support assembly and first rotating bracket assembly of FIG. 1 shown mounted in a rotatable manner on the bottom surface of a table top.
Figure 4A:
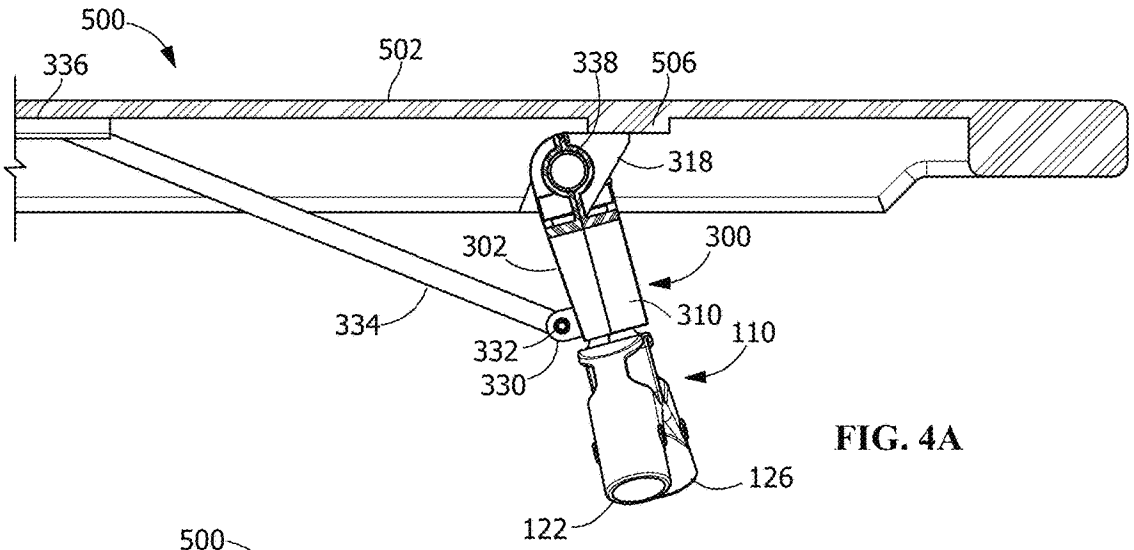
FIG. 4A is a partial cross-sectional, side view of the first support assembly and first rotating bracket assembly of FIG. 1 shown mounted in a rotatable manner on the bottom surface of a table top, wherein the first support assembly and first rotating bracket assembly are shown in an extended position.
Figure 5A:
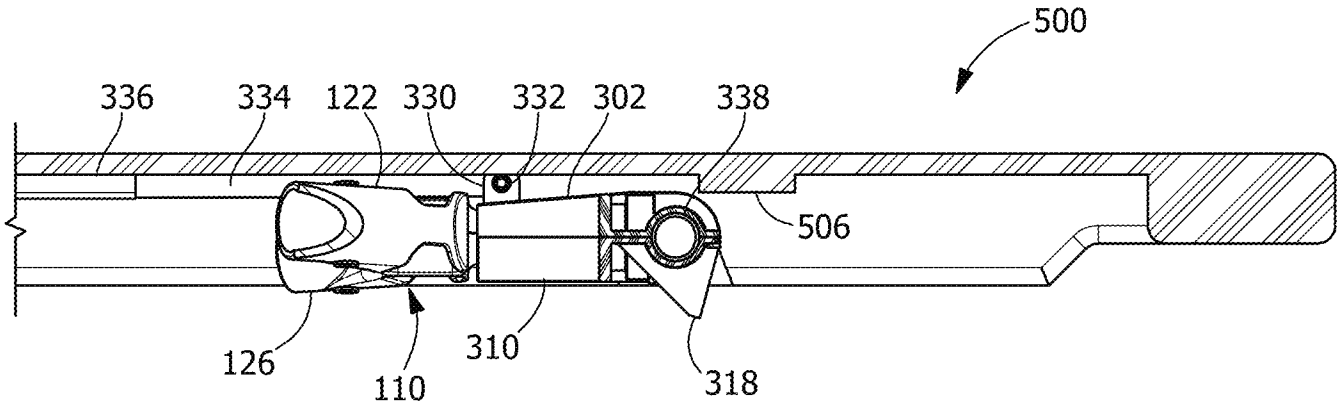
FIG. 5A is a partial cross-sectional, side view of the first support assembly and first rotating bracket assembly of FIG. 1 shown mounted in a rotatable manner on the bottom surface of a table top, wherein the first support assembly and first rotating bracket assembly are shown in a folded position.

FIG. 2 is an assembled, perspective view of first support assembly 100 and first rotating bracket assembly 300 shown mounted in a rotatable manner on bottom surface 504 of table top 500. FIG. 3 is an assembled, partial cross-sectional, perspective view of first support assembly 100 and first rotating bracket assembly 300 shown mounted in a rotatable manner on the bottom surface of table top 500. FIG. 4A is a partial cross-sectional, side view of first support assembly 100 and first rotating bracket assembly 300 shown mounted in a rotatable manner on the bottom surface of table top 500, wherein first support assembly 100 and first rotating bracket assembly 300 are shown in an extended position. Rear bracket portion 302 is adapted to attach to front bracket portion 310 after the two bracket portions have been mounted in a rotatable manner on dowel 338 (see FIG. 2). Collar 330, which is adapted to receive joining member or bolt 332, slides over collar receiving portion 316, through two slots 317, and one end of sliding bar 334 is placed between the open ends of collar 330. Bolt 332 is inserted through the openings in collar 330 and tightened to secure together the various components of rotating bracket assembly 300 as shown in FIGS. 2-3. As best shown in FIG. 2, table top 500 includes a top surface 502 and a bottom surface 504 which further includes first pad 506 and track portion 510. Moveable guide 336 for sliding bar 334 is mounted within track portion 510 and the end of sliding bar 334 that is not attached to collar 330 is slidably anchored in or to moveable guide 336. First rotational stop 318 and second rotational stop 320 prevent rotating bracket assembly 300 from rotating outward, and when force is applied to rotating bracket assembly 300 in an inward direction (i.e., toward the center of table top 500), the entire assembly rotates and folds into the closed position shown in FIG. 5A. Sliding bar 334 and guide 336 for sliding bar 334 ensures that first rotating bracket assembly 300 moves in a controlled, linear manner along the length of track formed in the bottom of table top 500.

Figure 4B:
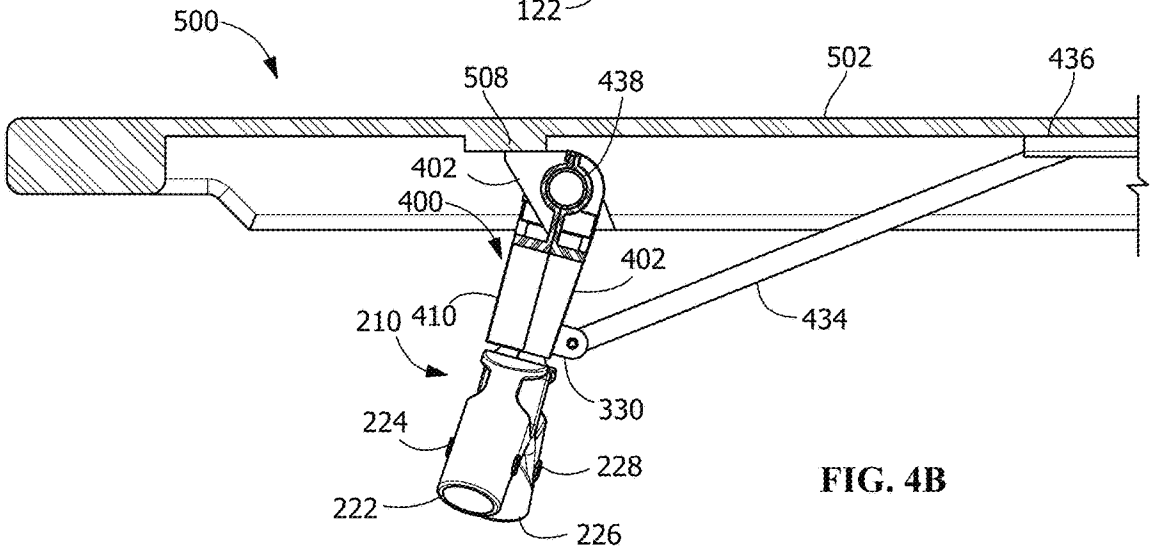
FIG. 4B is a partial cross-sectional, side view of the second support assembly and second rotating bracket assembly shown mounted in a rotatable manner on the bottom surface of a table top, wherein the second support assembly and second rotating bracket assembly are shown in an extended position.

FIG. 4B is a partial, cross-sectional, side view of second support assembly 200 and second rotating bracket assembly 400 shown mounted in a rotatable manner on the bottom surface of a table top, wherein second support assembly 200 and second rotating bracket assembly 400 are shown in an extended position. Second support assembly 200 includes pivot device 210, which is adapted to pivotally and rotationally engage second rotating bracket assembly 400. Pivot device 210 includes flange 212 (not shown in Figures), which is positioned on top of stem 214 (not shown in Figures). Upper leg receptacle 220 is formed integrally with pivot device 210 and includes first leg receiving portion 222, and second leg receiving portion 226. First leg 270 (not shown in Figures) is inserted into first leg receiving portion 222 and secured therein by first bolt or rivet 224. Second leg 272 (not shown in Figures) is inserted into second leg receiving portion 226 and secured therein by second bolt or rivet 228. Second rotating bracket assembly 400 includes rear bracket portion 402 and front bracket portion 410. Rear bracket portion 402 includes flange and stem receiving portion 404 (corresponding to the geometry of flange 212 and stem 214 on pivot device 210), dowel receiving portion 406, and bolt receiving portion 408. Front bracket portion 410 includes flange and stem receiving portion 412 (corresponding to the geometry of flange 412 and stem 414 on pivot device 410), dowel receiving portion 414, collar receiving portion 416, first rotational stop 418, and second rotational stop 420.

Figure 5B:
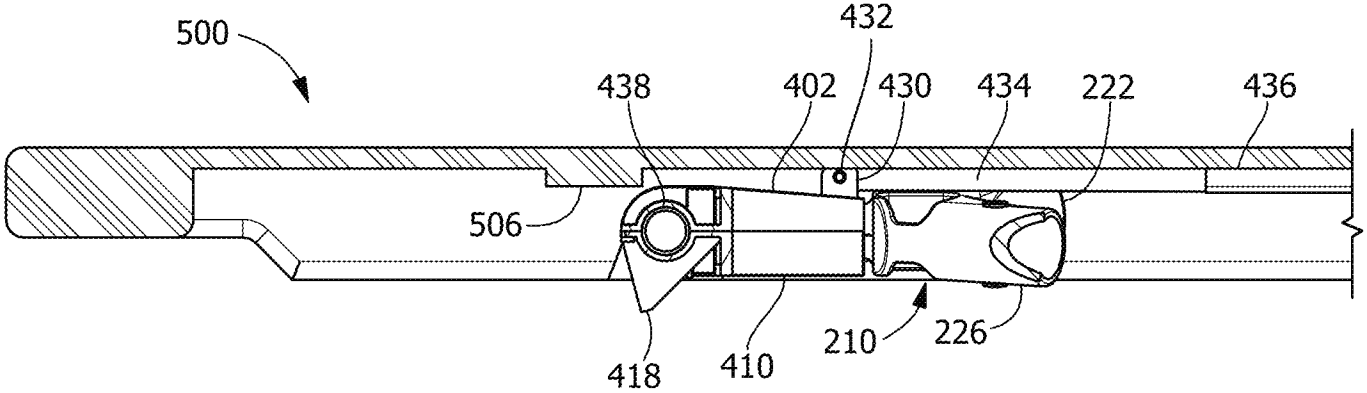
FIG. 5B is a partial cross-sectional, side view of the second support assembly and second rotating bracket assembly shown mounted in a rotatable manner on the bottom surface of a table top, wherein the second support assembly and second rotating bracket assembly are shown in a folded position.

Rear bracket portion 402 is adapted to attach to front bracket portion 410 after the two bracket portions have been mounted in a rotatable manner on dowel 438 (see FIG. 4B). Collar 430, which is adapted to receive joining member of bolt 432, slides over collar receiving portion 416 and one end of sliding bar 434 is placed between the open ends of collar 430. Bolt 432 is inserted through the openings in collar 430 and tightened to secure together the various components of rotating bracket assembly 400. Table top 500 includes a top surface 502 and a bottom surface 504 which further includes first pad 506 and track portion 510. Moveable guide 436 for sliding bar 434 is mounted within track portion 512 and the end of sliding bar 434 that is not attached to collar 430 is slidably anchored in moveable guide 436. First rotational stop 418 and second rotational stop 420 prevent rotating bracket assembly 400 from rotating outward, and when force is applied to rotating bracket assembly 400 in an inward direction (i.e., toward the center of table top 400), the entire assembly rotates and folds into the closed position shown in FIG. 5B. Sliding bar 434 and guide for sliding bar 436 ensures that rotating bracket assembly 400 moves in a controlled, linear manner along the length of track formed in the bottom of table top 500.

While the present invention has been illustrated by the description of exemplary embodiments thereof, and while the embodiments have been described in certain detail, there is no intention to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the general inventive concept.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, and by way of example, although the headings refer to the "Background", this is not to be construed as an admission that certain technology is prior art to any embodiment(s) in this disclosure. Neither is the "Summary" to be considered as a characterization of the embodiment(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure but should not be constrained by the headings set forth herein.

What is claimed is:

1. A foldable leg assembly for use with a self-leveling platform, comprising:

(a) at least one rotatable bracket assembly, wherein the at least one rotatable bracket assembly further includes:

(i) a first section including an upper portion and a lower portion, wherein a curved channel is formed in the upper portion thereof and wherein a stem and flange receiving region is formed in the lower portion thereof; and (ii) a second section adapted to be connected to the first section, wherein the second section includes an upper portion and a lower portion, wherein a curved channel is formed in the upper portion thereof and wherein a stem and flange receiving region is formed in the lower portion thereof, (iii) wherein the curved channels formed in the first and second sections of the at least one rotatable bracket assembly are adapted to enclose a cylindrical dowel, and when fully assembled, the at least one rotatable bracket rotates in a predetermined manner on the cylindrical dowel; and (b) at least one support device, wherein the at least one support device further includes a pivot device that is adapted to pivotally and rotationally engage the stem and flange receiving regions of the at least one rotatable bracket assembly, and wherein the pivot device further includes:

(i) a stem;

(ii) a flange positioned on top of the stem; and (iii) a leg receiving portion, wherein the leg receiving portion is adapted to receive at least two legs therein.

2. A foldable leg assembly for use with a self-leveling platform, comprising:

(a) at least one rotatable bracket assembly, wherein the at least one rotatable bracket assembly further includes:

(i) a first section including an upper portion and a lower portion, wherein a curved channel is formed in the upper portion thereof and wherein a stem and flange receiving region is formed in the lower portion thereof; and (ii) a second section adapted to be connected to the first section, wherein the second section includes an upper portion and a lower portion, wherein a curved channel is formed in the riper portion thereof and wherein a stem and flange receiving region is formed in the lower portion thereof, a) a wherein the first section of the at least one rotatable bracket assembly further comprises at least one rotational stop structure formed on the upper portion thereof and a collar receiving structure formed on the lower portion thereof, and b) wherein the second section of the at least one rotatable bracket assembly further comprises two collar receiving slots and a bolt receiving structure formed on the lower portion thereof; and (b) at least one support device, wherein the at least one support device further includes a pivot device that is adapted to pivotally and rotationally engage the stem and flange receiving regions of the at least one rotatable bracket assembly, and wherein the pivot device farther includes:

(i) a stem;

(ii) a flange positioned on top of the stem; and (iii) a leg receiving portion, wherein the leg receiving portion is adapted to receive at least two legs therein.

3. The foldable leg assembly of claim 2, further comprising a first leg and a second leg mounted within the leg receiving portion; and a crossbar positioned between the first and second legs such that the two legs and the crossbar form a triangular configuration.

4. A foldable leg assembly for use with a self leveling platform, comprising:

(a) at least one rotatable bracket assembly, wherein the at least one rotatable bracket assembly further includes:

(i) a first section including an upper portion and a lower portion, wherein a curved channel is formed in the upper portion thereof and wherein a stem and flange receiving region is formed in the lower portion thereof; and (ii) a second section adapted to be connected to the first section, wherein the second section includes an upper portion and a lower portion, wherein a curved channel is formed in the upper portion thereof and wherein a stem and flange receiving region is formed in the lower portion thereof; and (b) at least one support device, wherein the at least one support device further includes a pivot device that is adapted to pivotally and rotationally engage the stem and flange receiving regions of the at least one rotatable bracket assembly, and wherein the pivot device further includes:

(i) a stem;

(ii) a flange positioned on top of the stem; and (iii) a leg receiving portion, wherein the leg receiving portion is adapted to receive at least two legs therein; and (c) a table top that includes a top surface and a bottom surface, wherein the bottom surface further includes:

(i) a pad positioned to contact the at least one rotational stop structure;

(ii) a linear track formed therein, wherein the linear track is adapted to receive a guide for a sliding bar;

(iii) a sliding bar having a first end and a second end, wherein the first end is anchored within the guide and wherein the second end is attached to the bottom portion of the second section of the at least one rotatable bracket; and (iv) at least one transversely mounted cylindrical dowel to which the rotatable bracket assembly is attached.

5. The foldable leg assembly of claim 4, further comprising a U-shaped collar and a joining member, wherein the U-shaped collar and the joining member cooperate to connect the first and second sections of the at least one rotatable bracket to one another and wherein the joining member is operative to connect one end of the sliding bar to the bottom portion of the second section of the at least one rotatable bracket.

6. A foldable leg assembly for use with a self-leveling, platform, comprising:

(a) at least one rotatable bracket assembly, wherein the at least one rotatable bracket assembly further includes:

(i) a first section including an upper portion and a lower portion, wherein a curved channel is formed in the upper portion thereof and wherein a stem and flange receiving region is formed in the lower portion thereof; and (ii) a second section adapted to be connected to the first section, wherein the second section includes an upper portion and a lower portion, wherein a curved channel is formed in the upper portion thereof and wherein a stem and flange receiving region is formed in the lower portion thereof, (iii) wherein the curved channels formed in the first and second sections of the at least one rotatable bracket assembly are adapted to enclose a cylindrical dowel, and when fully assembled, the at least one rotatable bracket rotates in a predetermined manner on the cylindrical dowel; and (b) at least one support device, wherein the at least one support device further includes a pivot device that is adapted to pivotally and rotationally engage the stem and flange receiving regions of the at least one rotatable bracket assembly, and wherein the pivot device further includes:

(i) a stem;

(ii) a flange positioned on top of the stem;

(iii) a leg receiving portion, Wherein the leg receiving portion is adapted to receive at least two legs therein;

(iv) a first leg and a second leg mounted within the leg receiving portion; and (v) a crossbar positioned between the first and second legs such that the two legs and the crossbar form a triangular configuration.

7. A foldable leg assembly for use with a self-leveling platform, comprising:

(a) at least one rotatable bracket assembly, wherein the at least one rotatable bracket assembly further includes:

(i) a first section including an upper portion and a lower portion, wherein a curved channel is formed in the upper portion thereof and wherein a stem and flange receiving region is formed in the lower portion thereof; and (ii) a second section adapted to be connected to the first section, wherein the second section includes an upper portion and a lower portion, wherein a curved channel is formed in the upper portion thereof and wherein a stem and flange receiving region is formed in the lower portion thereof, a) wherein the first section of the at least one rotatable bracket assembly further comprises at least one rotational stop structure formed on the upper portion thereof and a collar receiving structure formed on the lower portion thereof, and b) wherein the second section of the at least one rotatable bracket assembly further comprises two collar receiving slots and a bolt receiving structure formed on the lower portion thereof; and (b) at least one support device, wherein the at least one support device further includes a pivot device that is adapted to pivotally and rotationally engage the stem and flange receiving regions of the at least one rotatable bracket assembly, and wherein the pivot device further includes:

(i) a stem;

(ii) a flange positioned on top of the stem;

(iii) a leg receiving portion, wherein the leg receiving portion is adapted to receive at least two legs therein;

(iv) a first leg and a second leg mounted within the leg receiving portion; and (v) a crossbar positioned between the first and second legs such that the two legs and the crossbar form a triangular configuration.

8. A foldable leg assembly for use with a self-leveling platform, comprising:

(a) at least one rotatable bracket assembly, wherein the at least one rotatable bracket assembly further includes:

(i) a first section including an upper portion and a lower portion, wherein a curved channel is formed in the upper portion thereof and wherein a stem and flange receiving region is formed in the lower portion thereof; and (ii) a second section adapted to be connected to the first section, wherein the second section includes an upper portion and a lower portion, wherein a curved channel is formed in the upper portion thereof and wherein a stem and flange receiving region is formed in the lower portion thereof; and (b) at least one support device, wherein the at least one support device further includes a pivot device that is adapted to pivotally and rotationally engage the stem and flange receiving regions of the at least one rotatable bracket assembly, and wherein the pivot device further includes:

(i) a stem;

(ii) a flange positioned on top of the stem;

(iii) a leg receiving portion, wherein the leg receiving portion is adapted to receive at least two legs therein;

(iv) a first leg and a second leg mounted within the leg receiving portion; and (v) a crossbar positioned between the first and second legs such that the two legs and the crossbar form a triangular configuration;

(c) a table top that includes a top surface and a bottom surface, wherein the bottom surface further includes:

(i) a pad positioned to contact the at least one rotational stop structure;

(ii) a linear track formed therein, wherein the linear track is adapted to receive a guide for a sliding bar;

(iii) a sliding bar having a first end and a second end, wherein the first end is anchored within the guide and wherein the second end is attached to the bottom portion of the second section of the at least one rotatable bracket; and (iv) at least one transversely mounted cylindrical dowel to which the rotatable bracket assembly is attached; and (d) a U-shaped collar and a joining member, wherein the U-shaped collar and the joining member cooperate to connect the first and second sections of the at least one rotatable bracket to one another and wherein the joining member is operative to connect one end of the sliding bar to the bottom portion of the second section of the at least one rotatable bracket.

9. A foldable leg assembly for use with a self-leveling platform, comprising:

(a) at least two rotatable bracket assemblies, wherein each rotatable bracket assembly further includes:

(i) a first section including an upper portion and a lower portion, wherein a curved channel is formed in the upper portion thereof and wherein a stem and flange receiving region is formed in the lower portion thereof; and (ii) a second section adapted to be connected to the first section, wherein the second section includes an upper portion and a lower portion, wherein a curved channel is formed in the upper portion thereof and wherein a stem and flange receiving region is formed in the lower portion thereof;

(iii) wherein the curved channels formed in the first and second sections of each rotatable bracket are adapted to enclose a cylindrical dowel, and when fully assembled, each rotatable bracket rotates in a predetermined manner on the cylindrical dowel; and (b) at least two support devices, wherein each support device further includes a pivot device that is adapted to pivotally and rotationally engage the stem and flange receiving regions of each rotatable bracket assembly, and wherein each pivot device further includes:

(i) a stem;

(ii) a flange positioned on top of the stem; and (iii) a leg receiving portion, wherein the leg receiving portion is adapted to receive at least two legs therein.

10. A foldable leg assembly for use with a self-leveling platform, comprising:

(a) at least two rotatable bracket assemblies, wherein each rotatable bracket assembly further includes:

(i) a first section including an upper portion and a lower portion, wherein a curved channel is formed in the upper portion thereof and wherein a stem and flange receiving region is formed in the lower portion thereof; and (ii) a second section adapted to be connected to the first section, wherein the second section includes an upper portion and a lower portion, wherein a curved channel is formed in the upper portion thereof and wherein a stem and flange receiving region is formed in the lower portion thereof, a) wherein the first section of each rotatable bracket further comprises at least one rotational stop structure formed on the upper portion thereof and a collar receiving structure formed on the lower portion thereof, and b) wherein the second section of each rotatable bracket further comprises two collar receiving slots and a bolt receiving structure formed on the lower portion thereof; and (b) at least two support devices, wherein each support device further includes a pivot device that is adapted to pivotally and rotationally engage the stem and flange receiving regions of each rotatable bracket assembly, and wherein each pivot device further includes:

(i) a stem;

(ii) a flange positioned on top of the stem; and (iii) a leg receiving portion, wherein the leg receiving portion is adapted to receive at least two legs therein.

11. The foldable leg, assembly of claim 10, further comprising a first leg and a second leg mounted within each leg receiving portion; and a crossbar positioned between the first and second legs such that the two legs and the crossbar form a triangular configuration.

12. A foldable leg assembly for use with a self-leveling platform, comprising:

(a) at least two rotatable bracket assemblies, wherein each rotatable bracket assembly further includes:

(i) a first section including an upper portion and a lower portion, wherein a curved channel is formed in the upper portion thereof and wherein a stem and flange receiving region is formed in the lower portion thereof; and (ii) a second section adapted to be connected to the first section wherein the second section includes an upper portion and a lower portion, wherein a curved channel is formed in the upper portion thereof and wherein a stem and flange receiving region is formed in the lower portion thereof; and (b) at least two support devices, wherein each support device further includes a pivot device that is adapted to pivotally and rotationally engage the stem and flange receiving regions of each rotatable bracket assembly, and wherein each pivot device further includes:

(i) a stem;

(ii) a flange positioned on top of the stem; and (iii) a leg receiving portion, wherein the leg receiving portion is adapted to receive at least two legs therein; and (c) a table top that includes a top surface and a bottom surface, wherein the bottom surface further includes:

(i) a pad positioned to contact each rotational stop structure;

(ii) a linear track formed therein, wherein the linear track is adapted to receive two guides for two sliding bars;

(iii) two sliding bars each having a first end and a second end, wherein each first end is anchored within a guide and wherein each second end is attached to the bottom portion of the second section of each rotatable bracket; and (iv) at least two transversely mounted cylindrical dowels, wherein each rotatable bracket assembly is attached to a cylindrical dowel.

13. The foldable leg assembly of claim 12, further comprising two U-shaped collars and two joining members, wherein each U-shaped collar and joining member cooperate to connect the first and second sections of each bracket to one another and wherein each joining member is operative to connect one end of each sliding bar to the bottom portion of the second section of each rotatable bracket.

* * * * *